US007549857B2

(12) United States Patent
Gutmark et al.

(10) Patent No.: US 7,549,857 B2
(45) Date of Patent: Jun. 23, 2009

(54) METHOD AND DEVICE FOR AFFECTING THERMOACOUSTIC OSCILLATIONS IN COMBUSTION SYSTEMS

(75) Inventors: Ephraim Gutmark, Cincinnati, OH (US); Christian Oliver Paschereit, Berlin (DE)

(73) Assignee: ALSTOM Technology Ltd., Baden (CH)

( * ) Notice: Subject to any disclaimer, the term of this patent is extended or adjusted under 35 U.S.C. 154(b) by 817 days.

(21) Appl. No.: 10/725,562

(22) Filed: Dec. 3, 2003
(Under 37 CFR 1.47)

(65) Prior Publication Data

US 2005/0019713 A1 Jan. 27, 2005

(30) Foreign Application Priority Data

Dec. 7, 2002 (DE) ..... 102 57 275

(51) Int. Cl.
*F23C 5/00* (2006.01)

(52) U.S. Cl. ..... 431/8; 431/12; 431/19; 431/114

(58) Field of Classification Search ..... 431/12 O, 431/114 X, 19, 75; 60/725
See application file for complete search history.

(56) References Cited

U.S. PATENT DOCUMENTS 4,262,482 A 4/1981 Roffe et al.
5,005,353 A 4/1991 Acton et al.
5,487,265 A * 1/1996 Rajamani et al. ..... 60/773
5,755,090 A 5/1998 Hu
6,205,764 B1 * 3/2001 Hermann et al. ..... 60/776
2002/0026796 A1 3/2002 Gutmark et al.
2005/0016180 A1 * 1/2005 Gutmark et al. ..... 60/772
2005/0016181 A1 * 1/2005 Gutmark et al. ..... 60/784

FOREIGN PATENT DOCUMENTS

DE 43 39 094 A1 5/1995
DE 196 41 843 4/1997
DE 199 34 612 A1 1/2001
DE 199 28 266 A1 2/2001
DE 199 48 673 A1 4/2001
EP 0 962 704 12/1999
EP 0 985 810 A1 3/2000

OTHER PUBLICATIONS

Search Report from DE 102 57 275.5 ( Apr. 23, 2003).
Search Report for European Appl. No. 03104406.8 ( Apr. 8, 2005).

* cited by examiner

*Primary Examiner*—Alfred Basichas
(74) *Attorney, Agent, or Firm*—Cermak Kenealy Vaidya & Nakajima LLP; Adam J. Cermak

(57) ABSTRACT

The present invention relates to a method and a device for affecting thermoacoustic oscillations in a combustion system (i) comprising at least one burner (2) and at least one combustor (3), modulated injection of fuel being carried out. In order to improve the action of affecting the thermoacoustic oscillations, the modulated injection of the fuel is carried out into a recirculation zone (7) which forms in the combustor (3).

7 Claims, 4 Drawing Sheets

METHOD AND DEVICE FOR AFFECTING THERMOACOUSTIC OSCILLATIONS IN COMBUSTION SYSTEMS

TECHNICAL FIELD

The invention relates to a method and a device for affecting thermoacoustic oscillations in a combustion system having at least one burner and at least one combustor.

PRIOR ART

It is known that undesired thermoacoustic oscillations frequently occur in combustors of gas turbines. The term "thermoacoustic oscillations" designates mutually self-reinforcing thermal and acoustic disruptions. In the process, high oscillation amplitudes can occur, which can lead to undesired effects, such as to high mechanical loading of the combustor and increased $NO_x$ emissions as a result of inhomogeneous combustion. This applies in particular to combustion systems with little acoustic damping. In order to ensure a high output in relation to pulsations and emissions over a wide operating range, active control of the combustion oscillations may be necessary.

In order to achieve low $NO_x$ emissions, in modern gas turbines an increasing proportion of the air is led through the burner itself and the cooling air stream is reduced. Since, in conventional combustors, the cooling air flowing into the combustor has a sound-damping effect and therefore contributes to the damping of thermoacoustic oscillations, the sound damping is reduced by the aforementioned measures for reducing the $NO_x$ emissions.

The generic EP 0 985 810 A1 discloses the fact that thermoacoustic oscillations can be affected by modulated injection of liquid or gaseous fuel being carried out.

There is a further demand to reduce the disruptive effect of the thermoacoustic oscillation systems to an even greater extent.

SUMMARY OF THE INVENTION

This is the starting point for the invention. The present invention concerns the problem of indicating a way of improving the action of affecting thermoacoustic oscillations in a combustion system.

The invention is based on the general idea, in a combustion system in whose combustor a recirculation zone is formed, of injecting fuel into this recirculation zone in a modulated manner. It has been shown that, as a result of this measure, the suppression of the thermoacoustic oscillations can be improved considerably. As a result of injecting fuel into the recirculation zone, the vortex systems forming in the combustor and affecting one another can be affected intensely. Since the vortex systems present in the combustor are substantially involved in the production of thermoacoustic oscillations, an effective effect on the thermoacoustic oscillations can be achieved by means of specific, modulated fuel injection.

Recirculation zones of this type which, according to the invention, are particularly suitable for the modulated injection of fuel, can form in the combustor in the case of specific burner-combustor configurations. For example, such a recirculation zone can form in the combustor if the swirling flow supplied from the burner collapses suddenly at the transition to the combustor. The collapse of such a swirling flow can be achieved, for example, by means of an abrupt increase in cross section in the transition between burner and combustor which, in conjunction with appropriate pressure relationships, has the effect of bursting the swirling flow, so to speak. Recirculation zones of this type are produced specifically in modern combustion systems, since they assist the formation of a stationary and stable flame front in the combustor. Stable combustion leads to a high efficiency and to low pollutant emissions. It is therefore of particular interest to produce a stable recirculation zone in the combustor. Since thermoacoustic oscillations which form can lead to instabilities in the recirculation zone, improved suppression or damping of the thermoacoustic oscillations leads to increased stability of the recirculation zone. By means of the modulated fuel injection into the recirculation zone, proposed according to the invention, said zone can thus be stabilized.

In accordance with an advantageous development, the injection of the total quantity of fuel can be carried out in such a way that a first quantity of fuel is injected at a constant rate, while a second quantity of fuel is injected in a modulated manner. This procedure ensures, firstly, that the combustible mixture in the combustor does not become excessively lean, in order to avoid extinguishing the flames. Secondly, this procedure makes use of the finding that the use of a (relatively small) quantity of the injected fuel is sufficient to achieve the desired influence on the thermoacoustic oscillations, as a result of the modulated injection. Since, therefore, only part of the fuel has to be injected in a modulated manner, the fuel supply device constructed for this purpose can be dimensioned correspondingly smaller.

In one development, provision can be made for the modulated injection of the fuel to be carried out exclusively into the recirculation zone and/or for the injection of fuel into the recirculation zone to be carried out exclusively in a modulated manner. In particular, the unmodulated injection of a constant quantity of fuel can then be carried out in a conventional way.

The modulated injection of the fuel into the recirculation zone can be carried out in the invention by means of a lance which projects into the burner. In this case, this lance expediently projects relatively far into the burner, in order to permit the injection of fuel into the recirculation zone.

Further important features and advantages of the invention emerge from the drawings and from the associated figure description using the drawing.

BRIEF DESCRIPTION OF THE DRAWINGS

Preferred exemplary embodiments of the invention are illustrated in the drawings and will be explained in more detail in the following description, identical references designating identical or similar or functionally identical components. In the drawings, in each case schematically.

PREFERRED EMBODIMENTS OF THE INVENTION

Figure 1:
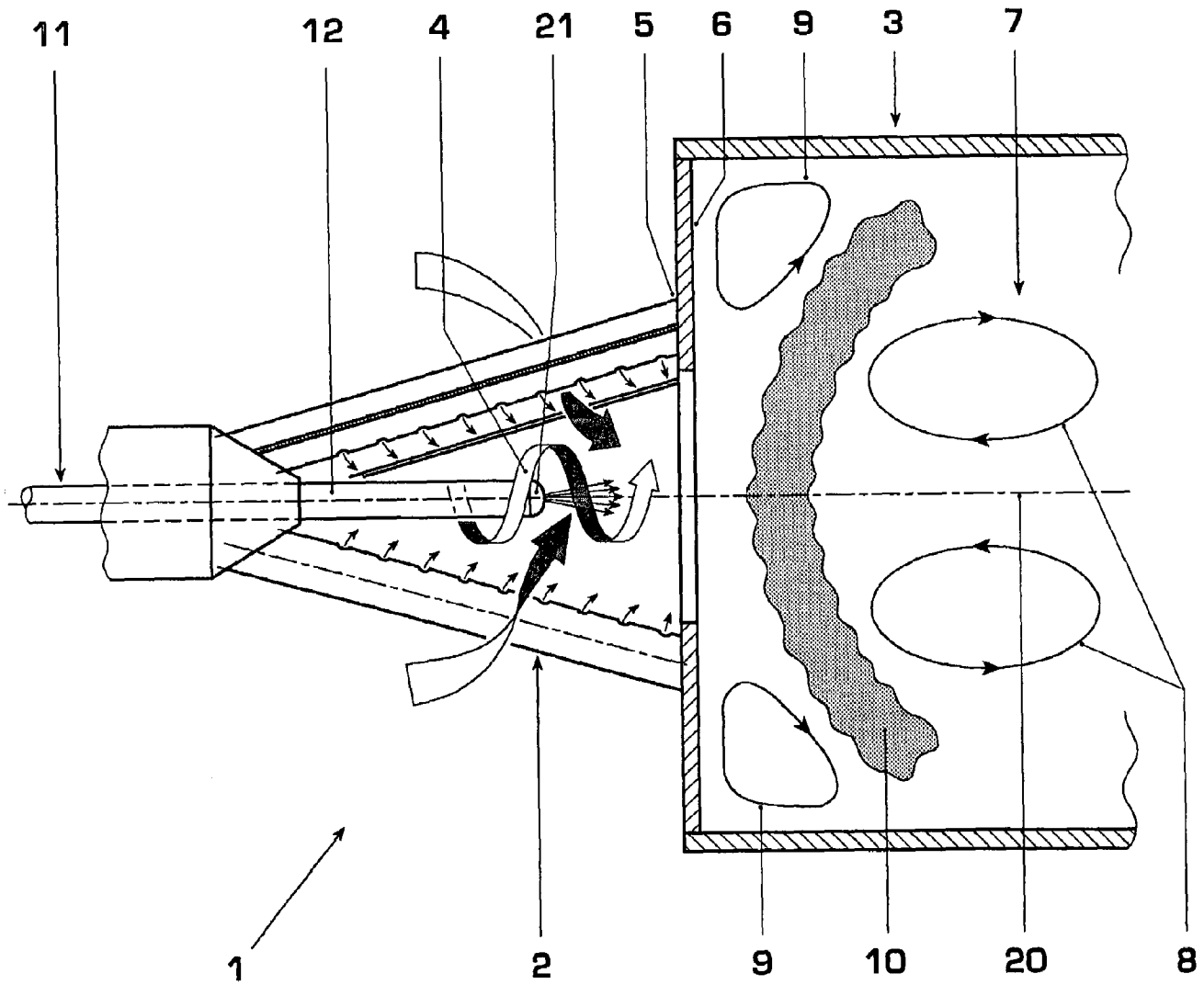
FIG. 1 shows a highly simplified basic illustration of a combustion system equipped with a device according to the invention.

According to FIG. 1, a combustion system 1 comprises at least one burner 2 and at least one combustor 3. The burner 2 is constructed here in such a way that a swirling flow is produced in it, which is indicated by a corresponding arrow 4. At 5, the burner 2 merges with an abrupt increase of cross section 6 into the immediately adjacent combustor 3. As a result, a central recirculation zone 7, which substantially consists of an annular, stationary vortex roll, so to speak, which is indicated by arrows 8, is formed in the combustor 3. A stationary vortex roll, which is indicated by arrows 9, can also form in the dead-water region of the increase of cross section 6. A flame front 10 which forms in the combustor 3 is in this case stabilized in particular by the recirculation zone 7.

According to the invention, a fuel supply system 11 has a lance 12, which projects into the burner 2 and is configured in such a way that liquid or gaseous fuel can be injected in a modulated manner into the recirculation zone 7 with the aid of this lance 12. The effect which is produced thereby on the recirculation zone 7 can be chosen specifically by means of appropriate modulation of the fuel injection such that damping or suppression of thermoacoustic oscillations of the combustion system 1 is achieved. Since these thermoacoustic oscillations are detrimental to the stability of the recirculation zone 7 and the flame front 10, the proposed, modulated fuel injection into the recirculation zone 7 leads to stabilization of the combustion in the combustor 3.

Figure 2:
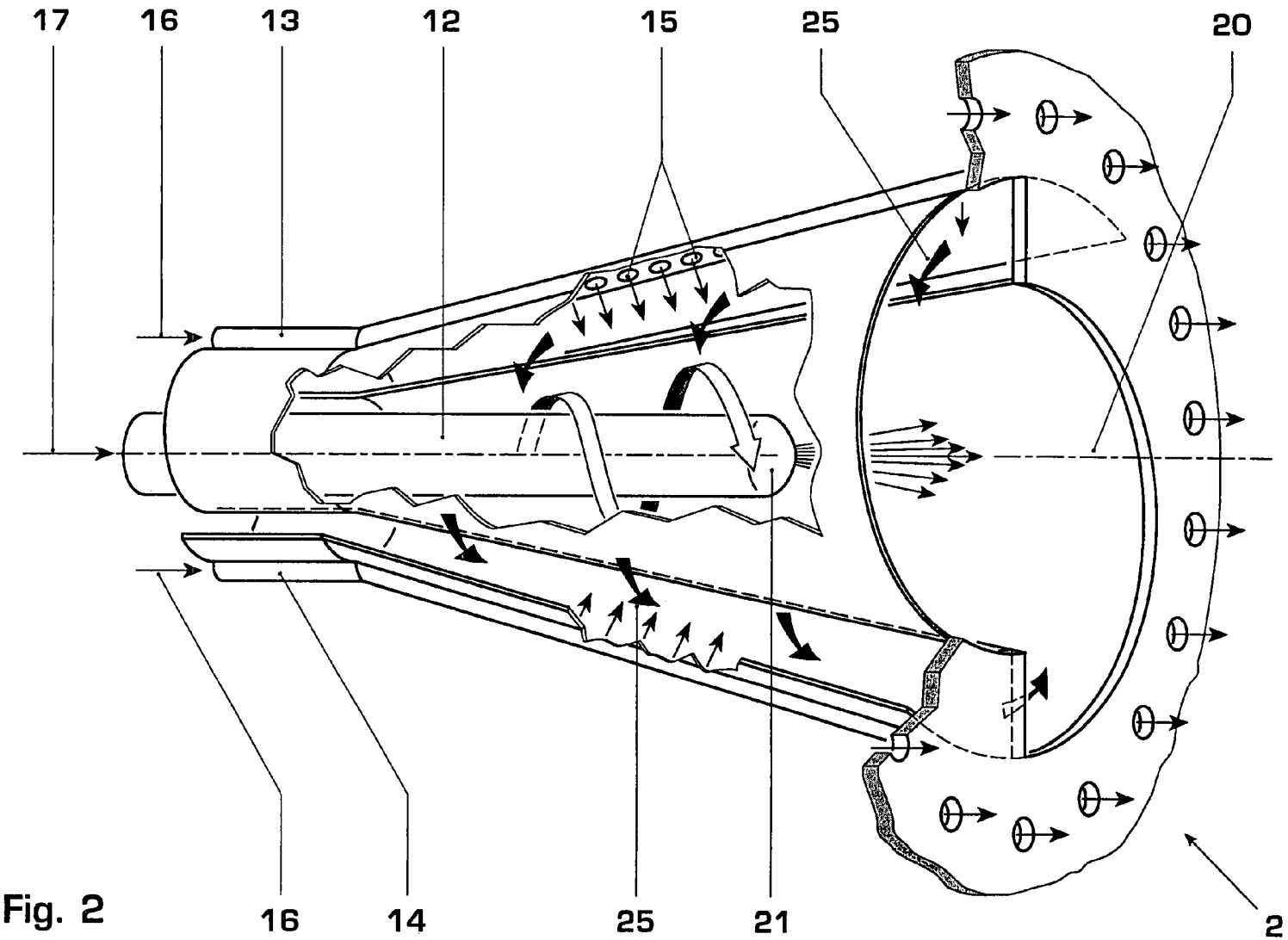
FIG. 2 shows a partly sectioned perspective illustration of a burner.

According to FIG. 2, the burner 2, which is designed here as a premixing burner, has two fuel lines 13 and 14, which are provided with openings 15. Gaseous or liquid fuel 16 can likewise be mixed with the combustion air 25 through these openings 15. The supply of fuel to the lance 12 is represented in FIG. 2 by an arrow 17.

Figure 3:
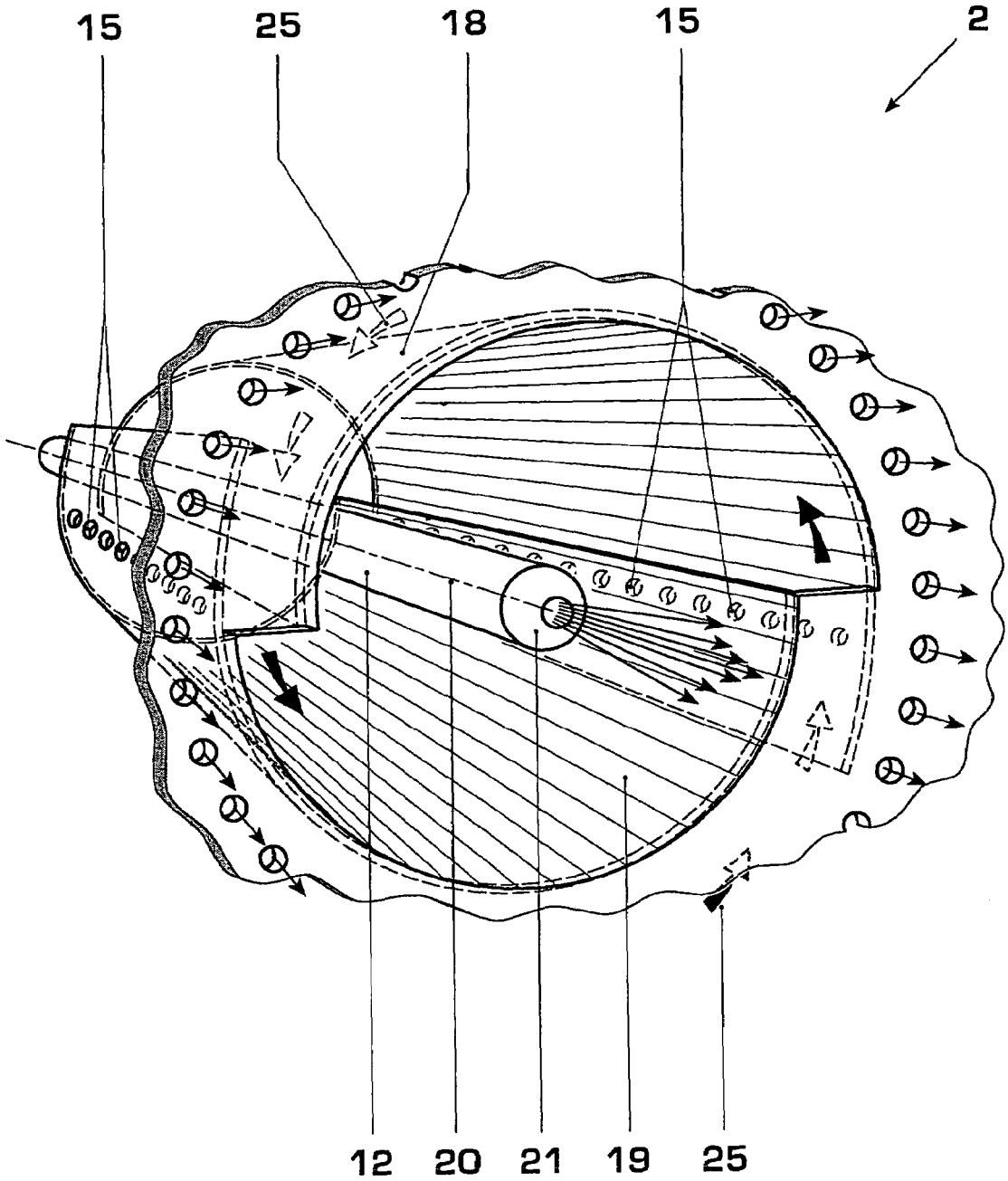
FIG. 3 shows a simplified illustration of the burner from FIG. 2 but from a different perspective.

The position of the openings 15 through which the fuel 16 is mixed with the combustion air 25 can be gathered better from FIG. 3. The fuel lines 13, 14 are fitted to portions 18 and 19 from which the burner 2 is assembled. The openings 15 are then lined up in a row along two straight lines which, with respect to a longitudinal mid-axis 20 of the burner 2, are diametrically opposite each other and intersect approximately at a point on the longitudinal mid-axis 20. In this way, all the openings 15 lie in one plane, what is known as the fuel injection plane.

In the embodiment shown here, the fuel is thus injected partly via the lance 12 and partly via the openings 15. In principle, an embodiment is also possible in which the fuel is injected exclusively via the lance 12. Preference is given to a variant in which the quantity of fuel injected via the lance 12 is smaller, in particular considerably smaller, than the quantity of fuel which is injected via the openings 15. For example, the quantity of fuel injected via the lance 12 is around 5% or less, in particular around 2%, of the quantity of fuel injected in total.

While the fuel can be injected into the recirculation zone 7 via the lance 12, the injection of fuel via the openings 15 clearly takes place within the burner 2. Apart from the lance 12, the burner illustrated in FIGS. 2 and 3 is therefore the same as the burner disclosed by EP 0 985 810 A1.

Accordingly, in order to affect the thermoacoustic oscillations, the injection of fuel via the openings 15 can additionally also be carried out in a modulated manner. In relation to the functioning of the additional modulated fuel injection through the openings 15, reference is made to EP 0 985 810 A1, whose content is hereby incorporated in the disclosure content of the present invention by express reference.

Accordingly, it is thus possible to inject the fuel in a modulated manner both via the lance 12 and via the openings 15. However, an embodiment in which the modulated fuel injection is carried out exclusively via the lance 12 is preferred.

According to a particularly advantageous embodiment, the modulated fuel injection can be carried out in such a way that the quantity of fuel injected in total is composed of a first quantity of fuel, injected at a constant rate, that is to say unmodulated, and a second quantity of fuel, injected in a modulated manner. In this way, it is possible to avoid the combustible mixture in the combustor being made leaner than the proportion of the quantity of fuel injected at a constant rate.

It has been shown that, in order to damp the thermoacoustic oscillations, it is sufficient to select the quantity of fuel injected in a modulated manner to be smaller, in particular considerably smaller, than the quantity of fuel injected at a constant rate. In this case, preference is given to an embodiment in which the modulated fuel injection is carried out exclusively via the lance 12, while the constant, that is to say unmodulated, fuel injection, is carried out exclusively via the openings 15. Accordingly, the abovementioned division again results, in which only about 5% or preferably 2% of the total quantity of fuel is injected into the recirculation zone 7 in a modulated manner via the lance 12.

As emerges from FIGS. 1 to 3, the lance 12 is arranged coaxially with respect to the longitudinal mid-axis 20 of the burner 2. The lance 12 in this case projects relatively far and centrally into the burner 2. In the embodiment illustrated, the lance 12 extends at least over 50%, in particular over about 75%, of the axial length of the burner 2.

The lance 12 is expediently constructed such that it carries out the fuel injection into the recirculation zone 7 axially, that is to say the fuel injected in a modulated manner emerges from the lance 12 at an axial end 21.

Figure 4:
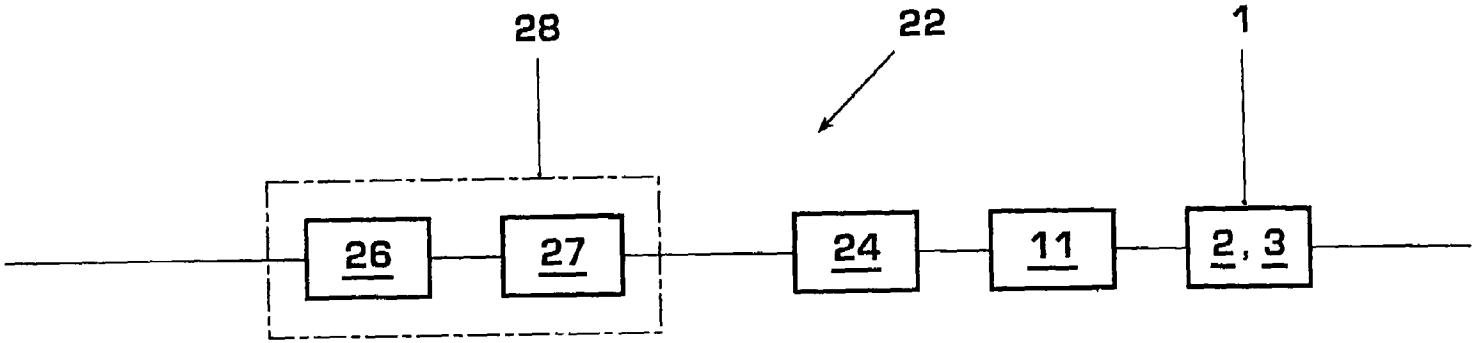
FIG. 4 shows an again simplified illustration of the combustion system with a control system.

In principle, the modulated injection of the fuel into the recirculation zone 7 can be carried out in such a way that the modulation is independent of an oscillation phase of the current thermoacoustic oscillations in the combustion system 1. According to FIG. 4, a device 22 according to the invention for affecting the thermoacoustic oscillations in the combustion system 1 can have a control system 23, which is merely symbolized here by a frame illustrated by broken lines. The device 22 additionally comprises at least one fuel valve 24 belonging to the fuel supply device 11, which comprises the lance 12. This fuel supply device 11 is coupled to the combustion system 1, which comprises the burner 2 and the combustor 3. For the purpose of simplification, burner 2 and combustor 3 are symbolized by a common rectangle in FIG. 4. Using the fuel valve 24, by means of appropriate actuation, the quantity of liquid or gaseous fuel supplied in a modulated manner to the combustion system 1 can be controlled. In the embodiment according to FIG. 4, the control system 23 is designed as an open control loop, that is to say an open-loop control loop, and contains a control signal generator 26 and an amplifier 27. The control signal generator 26 produces a control signal, independently of the thermoacoustic oscillations of the combustion system 1, which signal is amplified in the amplifier 27 and is used to actuate the fuel valve 24. The control signal generator 26 is designed, for example, for the nominal operating point of the combustion system, so that the control signals generated by it on the basis of experience effect adequate suppression of the thermoacoustic oscillations. It is likewise possible for the control signal generator 26 to generate the control signals as a function of current operating parameters of the combustion system 1, in particular with access to characteristic maps.

Figure 5:
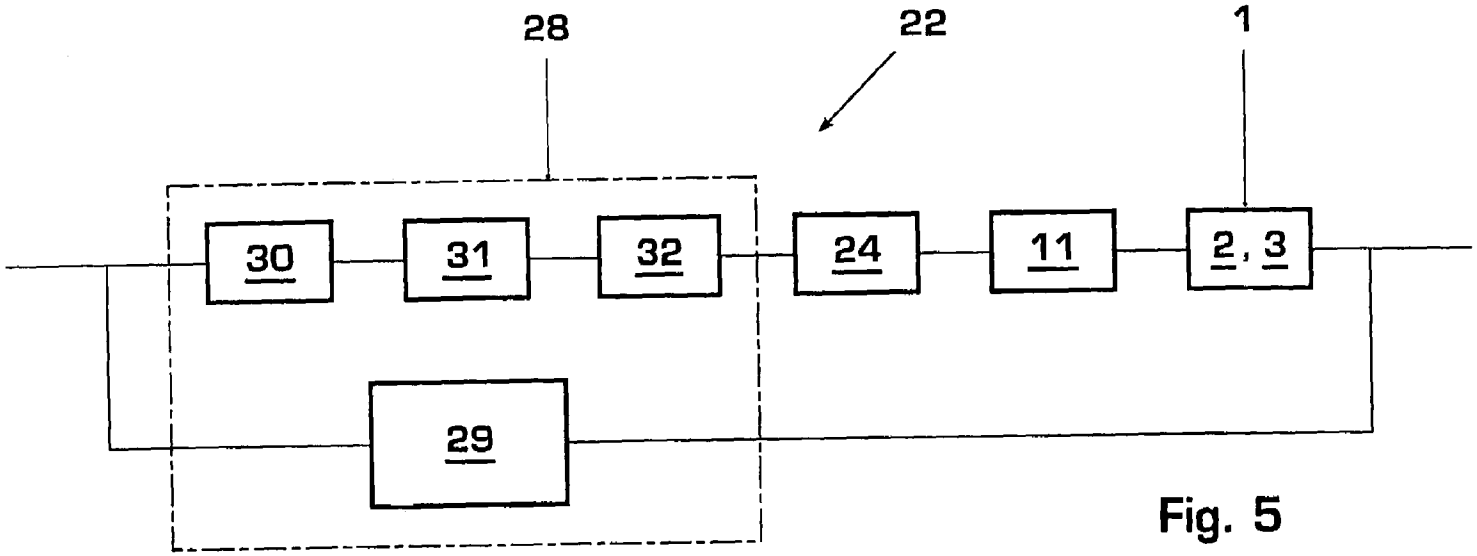
FIG. 5 shows an illustration as in FIG. 4 but in another embodiment of the control system.

According to FIG. 5, the device 22 in an alternative embodiment can have a different control system 28, which is designed as a closed control loop, that is to say a closed-loop control loop. The control system 28 in this case again actuates the at least one fuel valve 24 belonging to the fuel supply device 11 for supplying the combustion system 1, in particular its burner 2 and its combustor 3, with fuel. The control system 28 likewise contains a control signal generator 29, which receives an oscillation signal on the input side and, on the basis of said signal, generates the control signal for actuating the fuel valve 24 on the output side. The incoming oscillation signal correlates with the current thermoacoustic oscillations in the combustion system 1 and is determined by sensors not shown here. The oscillation signals determined by the sensors can be pressure signals, the sensors then comprising pressure sensors, preferably microphones, in particular water-cooled microphones and/or microphones with piezoelectric pressure transducers. It is likewise possible for the signals determined by the sensors to be formed by chemiluminescence signals, preferably by chemiluminescence signals from the emission of one of the radicals OH or CH. The sensors can expediently have optical sensors for visible or infrared radiation, in particular optical fiber probes.

The control signal generator 29 contains, for example, a special algorithm and/or characteristic maps in order to generate suitable control signals from the incoming oscillation signals. These control signals are then supplied to a filter 30 which, in particular, is designed as a band-pass filter or a high-pass filter and keeps back undesired, low-frequency interference. After the filter 30, the control signals are phase-shifted in a time delay element 31; they are then amplified in an amplifier 32 and can then be used to drive the fuel valve 24. The control system 28, in particular its control signal generator 29, can expediently drive the time delay element 31 for changing the phase shift and/or the amplifier 32 for changing the signal amplitudes and/or the filter 30 for changing the filter range as a function of the instantaneous pressure or luminescence signals. In this way, the influence of the control system 28 on the interfering frequency to be damped can be varied or tracked. While the embodiment shown in FIG. 4 produces modulated fuel injection which is independent of the current thermoacoustic oscillations, in particular independent of the oscillation phase of the current thermoacoustic oscillations, in the case of the embodiment shown in FIG. 5, the modulated fuel injection can be matched to the current thermoacoustic oscillations, in particular to the oscillation phase of the current thermoacoustic oscillations. In the variant according to FIG. 5, the instantaneous actuation of the fuel valve 24 is thus phase-coupled with the oscillation signal measured in the combustion system 1 and correlating with the thermoacoustic fluctuations. The oscillation signal can be measured downstream of the burner 2 in the combustor 3 or in a quietening chamber arranged upstream of the burner 2.

The mechanical fluidic stability of a gas turbine burner 2 is of critical importance for the occurrence of thermoacoustic oscillations. The mechanical fluidic instability waves arising in the burner 2 lead to the formation of vortices. These vortices, also referred to as coherent structures, play an important role in mixing processes between air and fuel. The spatial and temporal dynamics of these coherent structures affect the combustion and the liberation of heat. As a result of the modulated fuel injection, the formation of these coherent structures can be counteracted. If the production of vortex structures at the burner outlet is reduced or prevented, then the periodic fluctuation in the liberation of heat is also reduced thereby. These periodic fluctuations in the liberation of heat form the basis for the occurrence of thermoacoustic oscillations, however, so that, by means of the acoustic excitation, the amplitude of the thermoacoustic oscillations can be reduced.

By selecting a suitable phase difference, which differs depending on the type of measured signal, between the measured signal and instantaneous modulation of the fuel injection, the fuel injection counteracts the formation of coherent structures, so that the amplitude of the pressure pulsation is reduced. The aforementioned phase difference is set by the time delay element 31 and takes account of the fact that phase shifts generally occur as a result of the arrangement of the measuring sensors and fuel valves 24 and as a result of the measuring instruments and lines themselves. If the set relative phase is selected such that the result is the greatest possible reduction in the pressure amplitude, all these phase-rotating effects are implicitly taken into account. Since the most beneficial relative phase can change over time, the relative phase advantageously remains variable and can be tracked, for example via monitoring the pressure fluctuations, so that high suppression is always ensured.

With the aid of modulated fuel injection which, according to the invention, is carried out into the recirculation zone 7 of the combustor 3, the formation of thermoacoustic oscillations can be affected specifically. In this case, modulated fuel injection is understood to mean any time-varying injection of liquid or gaseous fuel. This modulation can be carried out, for example, at any desired frequency. The injection can be carried out independently of the phase of the pressure oscillations in the combustion system (cf. FIG. 4); however, the embodiment according to FIG. 5 is preferred, in which the injection is phase-coupled to the oscillation signal which is measured in the combustion system 1 and is correlated with the thermoacoustic oscillations. The modulation of the fuel injection is carried out by means of appropriate opening and closing of the fuel valve or valves 24, by which means the injection times (start and end of the injection) and/or the quantity injected are varied. As a result of the modulated fuel supply into the recirculation zone 7, the quantity of fuel converted into large-volume vortices can be controlled in the combustor 3. In this way, the formation of the coherent structures and thus the production of thermoacoustic instabilities can be affected.

Via the control signal generator 26 or 29 it may be possible, in particular, to vary the interfering frequency of the thermoacoustic oscillations to be affected with the aid of the device 22 according to the invention. For example, the main interfering frequency can depend on the respective operating state of the combustion system 1.

LIST OF REFERENCES

1 combustion system
2 burner
3 combustor
4 swirling flow
5 transition
6 increase of cross section
7 recirculation zone
8 vortex roll
9 vortex roll
10 flame front
11 fuel supply device
12 lance
13 fuel line
14 fuel line
15 opening
16 fuel
17 fuel
18 portion
19 portion

20 longitudinal mid-axis
21 axial end
22 device
23 control system
24 fuel valve
25 combustion air
26 control signal generator
27 amplifier
28 control system
29 control signal generator
30 filter
31 time delay element
32 amplifier

What is claimed is:

1. A method of affecting thermoacoustic oscillations in a combustion system having at least one burner and at least one combustor, the method comprising:

modulating fuel injection into a recirculation zone which forms in the combustor, wherein the total quantity of fuel injection comprises a first quantity and a second quantity;

injecting the first quantity of fuel at a constant rate; and injecting the second quantity of fuel in a modulated manner.

2. The method as claimed in claim 1, wherein the second quantity of fuel is smaller than the first quantity of fuel.

3. The method as claimed in claim 1, wherein the second quantity of fuel is approximately between 6% and 1% of the total quantity of fuel.

4. A method of affecting thermoacoustic oscillations in a combustion system having at least one burner and at least one combustor, the method comprising:

modulating fuel injection into a recirculation zone which forms in the combustor, wherein said modulating fuel injection is performed independently of an oscillation phase of the thermoacoustic oscillations.

5. A method of affecting thermoacoustic oscillations in a combustion system having at least one burner and at least one combustor, the method comprising:

modulating fuel injection into a recirculation zone which forms in the combustor, wherein said modulating fuel injection is coupled to an oscillation phase of the thermoacoustic oscillations.

6. A method of affecting thermoacoustic oscillations in a combustion system having at least one burner and at least one combustor, the method comprising:

modulating fuel injection into a recirculation zone which forms in the combustor, wherein said modulating fuel injection is performed exclusively into the recirculation zone.

7. A method of affecting thermoacoustic oscillations in a combustion system having at least one burner and at least one combustor, the method comprising:

modulating fuel injection into a recirculation zone which forms in the combustor, wherein said injection of fuel into the recirculation zone is performed exclusively in a modulated manner.

* * * * *